United States Patent [19]

Cooper et al.

[11] 3,984,447

[45] Oct. 5, 1976

[54] METHOD OF RECONSTITUTING USED COOKING OIL

[75] Inventors: Frank L. Cooper, Leesburg; Ray C. Fatout; William S. Hendrickson, both of Indianapolis, all of Ind.

[73] Assignee: C. H. F., Inc., Indianapolis, Ind.

[22] Filed: July 1, 1974

[21] Appl. No.: 484,430

[52] U.S. Cl. ..... 260/420; 426/417; 210/167

[51] Int. Cl.[2] ..... C11B 3/00; C11B 3/10

[58] Field of Search ..... 426/397, 438, 441, 253, 426/417, 423; 203/96; 156/12 R, 125; 210/167, DIG. 8; 99/408; 260/428, 420

[56] References Cited

UNITED STATES PATENTS

| | | | |
|---|---|---|---|
| 1,450,326 | 6/1918 | Maitland | 159/165 |
| 1,866,591 | 7/1932 | Baylis | 260/428 X |
| 2,368,669 | 2/1945 | Lee | 159/165 |
| 2,401,340 | 6/1946 | Dunwire | 260/428 X |
| 2,558,869 | 7/1951 | McColm | 260/428 X |
| 2,578,129 | 12/1951 | Dougherty | 210/167 X |
| 2,767,095 | 10/1956 | Smith | 426/438 |
| 3,197,386 | 7/1965 | Lau | 159/165 |
| 3,198,241 | 8/1965 | Baird | 159/DIG. 15 |
| 3,483,981 | 12/1969 | Gordon | 210/167 |
| 3,542,653 | 11/1970 | Lourey | 203/96 X |
| 3,646,882 | 3/1972 | Keating | 210/167 X |
| 3,759,388 | 9/1973 | Thomason | 210/167 |
| 3,857,866 | 12/1974 | Gibble | 260/428 |
| 3,895,042 | 7/1975 | Taylor | 206/428 X |

*Primary Examiner*—Robert Halper
*Attorney, Agent, or Firm*—Jenkins, Hanley & Coffey

[57] ABSTRACT

A method of reconstituting used cooking oil which includes the steps of gravity separation of constituents of high specific gravity under elevated temperatures and preferably a light vacuum, decanting the cleared oil, then without artificially-induced heating or cooling, passing the decanted oil through a fibrous filter such as, for instance, a string-wound or other cartridge-type filter and subsequently passing the oil through a Fuller's Earth (or equivalent) cartridge-type filter, thereafter adding a quantity of finely-divided bleaching clay to the filtered oil, further elevating the temperature and holding the mixture in a sterilizable container at the elevated temperature while agitating it, adding saturated steam and maintaining a vacuum for a period of approximately one-half hour, then cooling and filtering the mixture into a vacuumized atmosphere to remove the clay, and then cooling the filtered oil to a handling temperature and filling it into suitable containers for marketing it.

1 Claim, 1 Drawing Figure

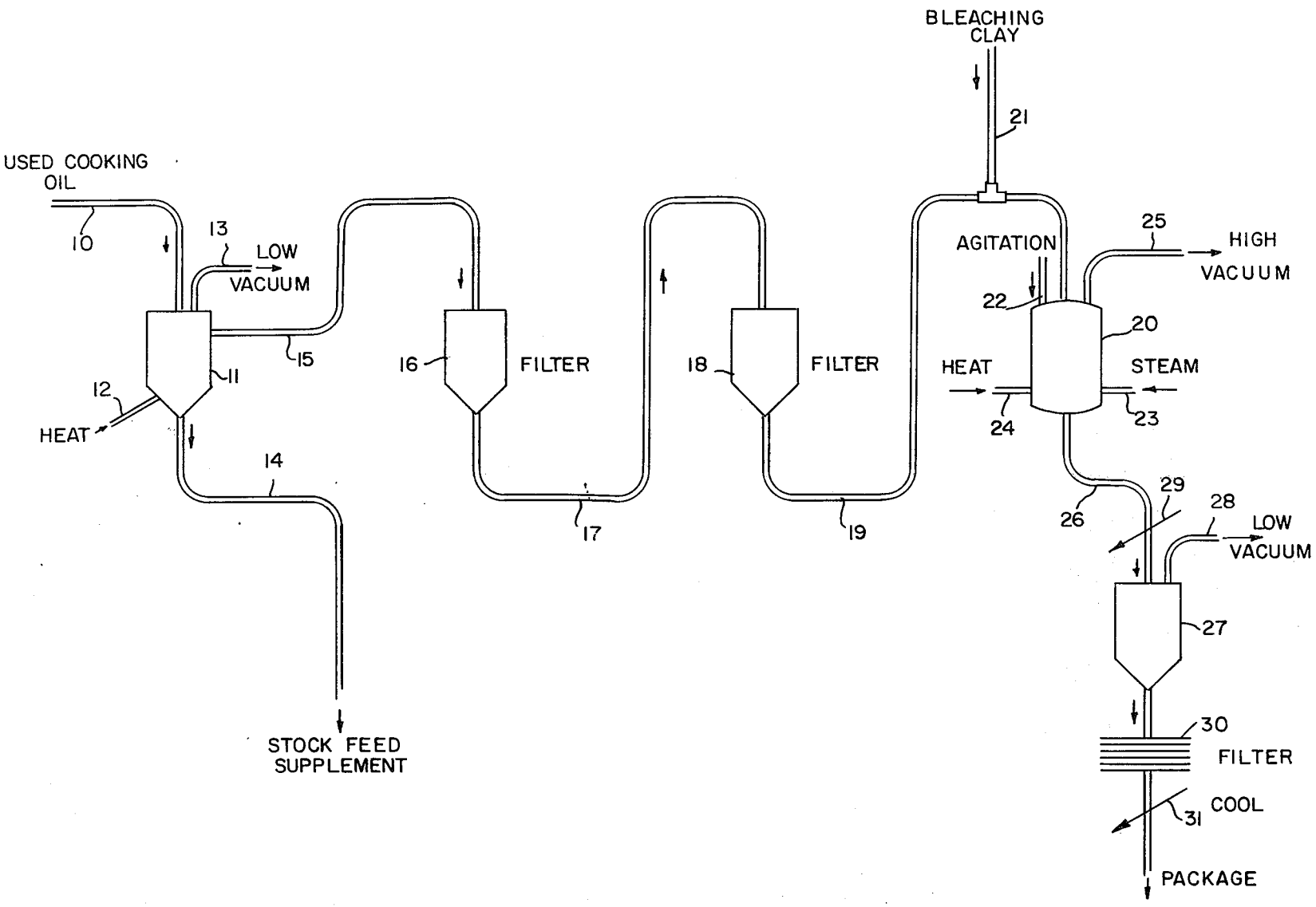
USED COOKING OIL
10
LOW VACUUM
13
11
12
HEAT
15
14
STOCK FEED SUPPLEMENT
FILTER
16
FILTER
18
17
19
BLEACHING CLAY
21
AGITATION
22
HEAT
24
20
STEAM
23
25
HIGH VACUUM
26
29
28
LOW VACUUM
27
30
FILTER
31
COOL
PACKAGE

METHOD OF RECONSTITUTING USED COOKING OIL

What is commonly known to the housewife as "deep fat frying" is used commercially on a tremendous scale, largely in relatively small, localized shops which specialize in chicken, fish, doughnuts or their analogues and other foods, catering to a considerable degree to the carryout trade. Every day, each of these little shops heats a vat full of cooking oil to bring it to, or very close to, a boil and maintains those several gallons of oil substantially at that temperature level throughout the period of operation of that stand, periodically dipping into the vat a quantity of one comestible or another to be cooked. Usually, the comestible is contained in a wire cage which can be dipped into the boiling oil to expose its contents to contact with the oil and is then lifted out of the vat when the predetermined cooking period comes to an end. Probably millions of gallons of edible oil are thus held at boiling temperature throughout every hour of every 12 to 18 hour day in this country; and of course the practice is not limited to this country.

Every time a charge of comestible is so dipped into the hot fat, moisture and other volatiles and unstables will be released from the comestible, sometimes chemically modified and to a considerable extent these substances will be entrained, emulsified and/or dissolved in the hot fat. In many cases, the comestible is dipped into a batter or otherwise coated before it is immersed in the oil and, for one reason or another, fragments of the coating break loose to be suspended in the oil or to sink to the bottom of the vat.

These and perhaps other contaminants not only darken the color of the oil but some of them are believed to produce chemical changes in the oil and, without doubt, some of them, and particularly the moisture, gradually lower the boiling point of the liquid. Thus, after a certain number of hours of use, a particular charge of oil becomes so modified and polluted that it can no longer be satisfactorily used for further cooking, not only because it tends to transmit foreign odors and flavors to the comestible but also because the boiling point of the liquid will ultimately be lowered to a point at which the comestible will not be satisfactorily browned. As a result, the used oil is customarily discarded, the vat is thoroughly cleaned and a new charge of cooking oil must be introduced into the vat.

Many kinds of shortenings are available on the market, some in liquid form and others in varying degrees of semi-solidity. Some of the latter may be said to be fluent, but others are as hard as cold lard. Common to all of them is the fact that, at cooking temperatures, they are liquid. Throughout the present disclosure, the word "oil" is used to refer to a cooking medium which is always liquid at cooking temperatures, whose viscosity varies generally inversely in relation to its temperature and which may or may not be merely fluent, substantially solid or thixotropic at room temperatures or below.

The necessity for thus discarding relatively large quantities of oil at frequent intervals is a significant factor in the cost of operation of an establishment of the character above suggested. Therefore, many attempts have been made to reclaim used cooking oil. Most of such attempts which are known to us, however, have concerned themselves solely with the removal of solids which have accumulated in the oil, by gravity separation and/or single or multi step filtration. In this disclosure, the expression "gravity separation," and its grammatical variants, will be used to include separation according to specific gravities by, for instance, centrifuging. We have found that, while such procedures do get rid of solid particles to a degree dependent upon the efficiency of separation and do sometimes modify the color of the oil and its clarity, they have little or no effect upon foreign flavors or odors and they do nothing toward restoring the boiling point to the value originally characteristic of the unused oil.

The primary object of the present invention, then, is to provide a process or method whereby used cooking oil, with all of its pollutants, can be reconstituted to duplicate the physical properties which were characteristic of the oil before it was put into use for cooking so that the reconstituted oil can be charged into a cooking vat and there will produce precisely the results which would be produced by a completely new charge of the original kind of oil.

Another object of the invention is to provide a reconstituting procedure so effective that, upon its adoption, shops will not dump their used oil, thus wasting great quantities of valuable natural resources and inevitably creating unsanitary conditions near the waste port, but instead would transfer the used oil cleanly to sterilizable containers for transportation to a reconstituting station.

A further object of the invention is to remove the major solids from a charge of used cooking oil and use those solids as an ingredient of stock feed.

Still further objects of the invention will appear as the description proceeds.

To the accomplishment of the above and related objects, our invention may be embodied in the steps described in the following specification, attention being called to the fact, however, that the specific procedure described is by way of illustration only and that changes may be made therein, so long as the scope of the appended claims is not violated.

IN THE DRAWINGS

The single FIGURE is a flow sheet illustrating the steps involved in our newly invented method.

Referring more particularly to the drawing, 10 represents a conduit through which used cooking oil may be delivered to a gravity separation device 11. As has been stated, the device 11 may be merely a settling chamber or it may be a centrifuge or other apparatus usable to make a specific-gravity separation between the oil and any major particles of solid material which may be suspended therein or mixed therewith. Preferably, the contaminated oil will be held within a preferred temperature range of 235° F. to 260° F., the optimum temperature being 250° F., and a means for heating the container 11 is indicated at 12. Preferably, also, the separation in the device 11 will be carried out under a slight vacuum, particularly if the temperature of the oil is below 235° F. The use of vacuum will facilitate entrapment of vapors to avoid polluting the atmosphere and a vacuum line for that purpose is indicated at 13 in the drawing.

As has been indicated, the solids which are separated in the apparatus 11 are quite high in nutritional value since they consist almost entirely of bits and pieces of the comestible which has been cooked in the oil; and we have indicated a line 14 to represent means for withdrawing such solids from the apparatus 11 and conducting them to a point at which they may be packed for sale. Obviously, it may be desirable to compact the mass of solids into coherent pieces and it may be desirable somewhat to dry the mass by compression or otherwise.

After the gravity separation, the somewhat clarified oil is transported, for instance through a conduit 15, to a first filter 16. The filter 16 may be a fibrous type filter having a density measure of about 25 microns. One satisfactory type of filter which we have used at this point is a string-wound cartridge. Here, smaller, lighter solid or semi-solid particles will be arrested as the oil passes through the filter. The temperature as it passes through the filter 16 should be in a range between 100° F. and 300° F., depending largely upon the economics of the situation. Obviously, the oil emerges from the gravity separator 11 at a temperature above normal atmospheric temperature. Usually, neither artificial cooling nor artificial heating should be necessary between the units 11 and 16.

The filtered oil passes on through for instance, a conduit 17 to a second filter 18 which may preferably be a conventional Fuller's Earth filter 18 where substantially all vestigial particles will be intercepted so that the oil passes on through the conduit 19 in substantially solid-free condition.

Usually, the oil will not need to be artificially heated or cooled as it passes through the conduit 17 and the filter 18 nor as it passes through the conduit 19 toward the container 20.

Near the entry to the container 20, the conduit 19 may be provided with a controllable branch 21 through which a suitable quantity of finely divided activated bleaching clay is introduced to the stream approaching the container 20. We presently believe that an optimum amount of such clay is from 12% to 25% by weight of the oil to be treated. The amount of clay to be used is largely a function of the color of the oil as it approaches the container 20. We presently believe that the optimum color for our finished product is somewhat golden, rather than white like "Crisco" shortening and we find that the optimum color can be attained with consistency if the quantity of clay used is within the above range, more clay being used when the color of the oil approaching the branch 21 is quite dark and less clay being used when that color is lighter.

To meet FDA standards, those portions of the interior of the container 20 with which the oil will come in contact must be sterilizable, and therefore that container will be made from, or lined with, such a sterilizable material which may be glass, stainless steel or any other available material meeting that requirement.

The oil must be held in the container 20 for a significant period of time on the order of ½ hour. While it is held there, the oil and clay mixture must be continuously agitated and at 22 we indicate agitating mechanism. Preferably the agitating means may be a downwardly-facing propeller located near the top of the interior of the container 20 and power driven at a rate sufficient to maintain the clay in substantially homogeneous suspension but not sufficient to cause foaming.

To provide further agitation and to maintain an inert atmosphere in the container 20, saturated steam at approximately 3 pounds pressure is continuously supplied, as through a line 23, to the container 20 at a point near its bottom so that the steam will continuously bubble upward through the material in the container. The mixture in the container 20 is maintained at a temperature within the range between 380° F. and 410° F., the optimum temperature for this step being 395° F. Heat for this purpose is supplied by suitable heating means indicated by the arrow 24. We have found that one good heating means for this purpose is a conventional electric heat mantle with a heat density of approximately 16 watts per square inch of heating surface maximum, to prevent local thermal decomposition.

A relatively high vacuum in the range above 25 inches of mercury is maintined in the container 20 as, for instance, through a line 25.

The oil and clay mixture is held in the container 20 under the above described conditions for a period of approximately ½ hour during which time the heat and the agitation in an inert atmosphere breaks down the free fatty acids and dissolved unstables and the moving steam acts as a stripping agent to eliminate such substances from the mixture and carry them away through the evacuating line 25.

After the above step has been completed, the mixture is drawn off, as through a line 26, is cooled as at 29 to a temperature of approximately 220° F. and is then double filtered through a suitable filtering means 27 in which an atmosphere at approximately 25 inches of mercury is maintained as, for instance, through a line 28 leading to an evacuator. The filtrate now passes through a final filter 30 after which it is cooled further as at 31 to a handling temperature of about 100° F. whereupon it may be filled, by any suitable means, into suitable commercial packages for sale.

A number of samples of various kinds of used oil have been passed through the above process and then have been compared with like quantities of new oils of the same kind. Among the specimens so tested have been "frymax", "Crisco" oil and "Crisco" retailed in a semi-solid form. In every instance, the pertinent physical properties of the oil after reconstitution have been substantially identical with the same properties of unused specimens of the same product. Particularly, and perhaps most importantly, the boiling points of the reconstituted specimens have been the same as the boiling points of the unused specimens. Thus, cooking oils which have been used to or beyond the limits of their utility are returned, by means of our process, to their pristine conditions and can be used for further cooking with all of the benefits which would be accomplished by their unused analogues.

When practiced upon commercial quantities of used oil, our process is much cheaper than the preparation of new oils and therefore will permit the sale of reconstituted oils at prices significantly lower than the prices necessarily charged for newly-manufactured oils.

We claim as our invention:

1. The method of reconstituting used cooking oil which comprises the steps of treating the oil in liquid state in a succession of clarifying steps including at least one gravity separation step and passage through a fibrous filter having a density measure not substantially exceeding 25 microns and through a Fuller's Earth filter, to remove suspended solids therefrom, mixing the clarified oil with at least about 12% by weight of activated bleaching clay, heating the mixture to a temperature between about 380° F. and about 410° F., and agitating the mixture and maintaining it at such temperature and in an inert atmosphere at subatmospheric pressure for a period of time of the order of one-half hour, then partially cooling the mixture and filtering it to remove the bleaching clay from the oil, wherein the temperature of the oil is held in the range between 235° F. and 260° F. during the gravity separation step, the agitation of the oil and clay mixture is accomplished by the joint action of mechanical means and saturated steam at about 3 psi bubbling upwardly through the heated mixture, and the inert atmosphere is maintained under a vacuum of at least about 25 inches of mercury.

* * * * *